US005293199A

United States Patent [19]

Saito et al.

[11] Patent Number: 5,293,199

[45] Date of Patent: Mar. 8, 1994

[54] IMAGE FORMING APPARATUS HAVING SPACING ROLLER FOR MAINTAINING UNIFORM SPACING BETWEEN IMAGE BEARING MEMBER AND DEVELOPING MATERIAL SUPPLYING MEANS

[75] Inventors: Naomasa Saito; Tatsumi Fujishima, both of Toyokawa; Shoichi Suzuki, Aichi, all of Japan

[73] Assignee: Minolta Camera Kabushiki Kaisha, Osaka, Japan

[21] Appl. No.: 694,337

[22] Filed: May 1, 1991

[30] Foreign Application Priority Data

May 11, 1990 [JP] Japan ..... 2-049717[U]
Dec. 3, 1990 [JP] Japan ..... 2-404598
Mar. 26, 1991 [JP] Japan ..... 3-060734

[51] Int. Cl.[5] ..... G03G 21/00

[52] U.S. Cl. ..... 355/215; 355/200; 355/245

[58] Field of Search ..... 355/215, 245, 260, 200, 355/210, 251, 253, 268, 269, 305; 118/653, 656–658, 661

[56] References Cited

U.S. PATENT DOCUMENTS 3,987,756 10/1976 Katayama et al. ..... 118/637
4,213,617 7/1980 Salger ..... 355/215 X
4,897,693 1/1990 Sawayama ..... 355/215
5,021,830 6/1991 Koiso ..... 355/215
5,057,868 10/1991 Sekino et al. ..... 355/215

FOREIGN PATENT DOCUMENTS 54-25839 2/1979 Japan .
1-62562 4/1989 Japan .
1-297685 11/1989 Japan .

OTHER PUBLICATIONS

Smith, "Seal Arrangement", Xerox Disclosure Journal, Jun. 1976, vol. 1, No. 6, pp. 49–50.

*Primary Examiner*—A. T. Grimley
*Assistant Examiner*—Shuk Y. Lee
*Attorney, Agent, or Firm*—Willian Brinks Hofer Gilson & Lione

[57] ABSTRACT

An image forming apparatus has an image bearing member rotatable in a specified direction, a developing roller for supplying developing material to a latent image formed on the image bearing member, a spacing roller rotatably supported on a shaft of the developing roller and making contact with the edge of the image bearing member in the axial direction, and a seal member having a portion that contacts the image bearing member on the upstream side of the developing roller in the direction of rotating and a portion that contacts the image bearing member on the developing roller side. The spacing roller forms the desired developing gap between the surface of the developing roller and the surface of the image bearing member. The seal member sweeps the surface of the image bearing member so as to mainly prevent the adhesion to the spacing roller of the airborne toner which is in the vicinity of the surface of the image bearing member and the surface of the developing roller. Further, the toner adhering to the surface of the image bearing member is cleaned therefrom by the seal member before the toner reaches the spacing roller. Thus, the precision of the developing gap can be maintained in the desired condition over a long period of time.

10 Claims, 7 Drawing Sheets

IMAGE FORMING APPARATUS HAVING SPACING ROLLER FOR MAINTAINING UNIFORM SPACING BETWEEN IMAGE BEARING MEMBER AND DEVELOPING MATERIAL SUPPLYING MEANS

BACKGROUND OF THE INVENTION

1. Field of the Invention

The present invention relates to an image forming apparatus for copying machines and printers using an electrophotographic process, and more specifically relates to an image forming apparatus constructed so as to bring a spacing roller attached to a developing material supplying means at a predetermined positional relationship into contact with an image bearing member to maintain a uniform spacing between the image bearing member and the developing material supplying member and supply developing material from the developing material supplying means to the image bearing means.

2. Description of the Prior Art

Conventional image forming apparatus using electrophotographic processes form an electrostatic latent image on the surface of an image bearing member by electrically charging the image bearing member with a charging means and irradiating the charged region of the image bearing member with light corresponding to a document image. The thus formed electrostatic latent image on the surface of the image bearing member is then developed by a developing device that supplies developing material thereto, and the developed image is transferred to a transfer sheet and fixed thereon.

The previously mentioned developing device may be any of several well known types of developing devices for developing electrostatic latent images such as, for example, a magnetic brush developing device using either a two-component developing material comprising a toner and a magnetic carrier or a monocomponent developing material comprising a magnetic toner. A magnetic brush developing device maintains a magnetic brush formed of developing material on the surface of a developing material carrying member and transports the developing material from the developing material carrying member to the developing region to develop an electrostatic latent image. Another type of common developing device applies a bias voltage to induce the developing material to "jump" from the developing material carrying member to the electrostatic latent image.

The aforesaid types of developing devices must provide a spacing between the developing material carrying member and the image bearing member, i.e., provide a developing gap, so as to assure suitable developing.

Means for setting the aforesaid developing gap are disclosed, for example, in U.S. Pat. No. 3,987,756 and Japanese Patent application Ser. No. 1-62562, which provide a spacer collar at the end of the rotatable shaft of a developing roller used as the developing material carrying member. The aforesaid spacer collar sets a developing gap by abutting the surface on the edge of a photosensitive drum which is used as the electrostatic latent image bearing member.

In the aforesaid type of developing gap setting means, however, the spacer collar is normally exposed to the airborne toner particles floating near the surface of the photosensitive drum and elsewhere within the image forming apparatus. These airborne toner particles become interposed between the surface of the collar and the surface of the photosensitive drum and gradually adhere to and accumulate on said surfaces. The aforesaid toner deposits reduce the precision of the developing gap and result in irregular image density and inferior image quality.

The previously mentioned Japanese Patent application Ser. No. 1-62562 proposes the use of a cleaning member to wipe the surface of the photosensitive drum on the developing roller side away from the spacer collar, but the use of such a cleaning member does not prevent the adhesion of the airborne toner particles on the spacer collar.

A related problem arises from damage to members that come into contact with the spacer collar. For example, when the spacer collar comes into contact with the edge of the photosensitive drum, the photosensitive layer of the drum is gradually peeled away and results in gradually reducing the precision of the developing gap, while also allowing the particles of the photosensitive layer peeled from the drum to become mixed with the developing material, thereby contaminating the developing material with a foreign substance.

A means for eliminating the previously described disadvantages has been proposed wherein the photosensitive layer is previously peeled from the edge portion of the photosensitive drum that abuts the spacer collar so that the spacer collar makes contact with the edge portion of the photosensitive member from which the photosensitive layer has already been peeled.

However, the operation by which the photosensitive layer is peeled from the edge portion of the photosensitive drum is very problematic, detracts from the producibility of the photosensitive drum, and increases production costs. Further, the electrical potential of the edge portion of the photosensitive drum which has had the photosensitive layer peeled therefrom does not rise even when the peeled photosensitive drum is electrically charged by the charging means. Therefore, when a reversing development process is used in a printer or the like, a quantity of the developing material adheres to the edge portion of the photosensitive drum that abuts the spacer collar. The aforesaid adhered developing material becomes interposed between the edge portion of the photosensitive drum and the spacer collar, thereby leading to further disadvantages such as reducing the precision of the developing gap and causing loss of stability in producing high quality images.

SUMMARY OF THE INVENTION

A main object of the present invention is to provide an image forming apparatus constructed so as to bring a spacing roller attached to a developing material supplying means into contact with an image bearing member to maintain a uniform spacing between the image bearing member and the developing material supplying member and supply developing material from the developing material supplying means to the image bearing means, said image forming apparatus being characterized by preventing developing material from intruding between the spacing roller and the image bearing means, and precisely maintaining the spacing between the developing material supplying means and the image bearing means over a long term and preventing poor images arising from irregular image density and the like caused by reduced precision in the aforesaid spacing.

These and other objects of the present invention are accomplished by providing an image forming apparatus comprising an image bearing member that is rotatable in a specified direction, a developing material supplying means for supplying developing material to a latent image formed on the image bearing member, a spacing roller rotatably provided on the developing material supplying means and making contact with the edge of the image bearing member in the axial direction, and seal members for preventing the intrusion of developing material into the atmosphere of the aforesaid contact region, said seal members being arranged so as to circumscribe the region wherein the spacing roller makes contact with the image bearing member and having a portion that contacts the image bearing member on the upstream side of the developing material supplying means in the direction of rotation and a portion that contacts the image bearing member on the developing material supplying means side.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
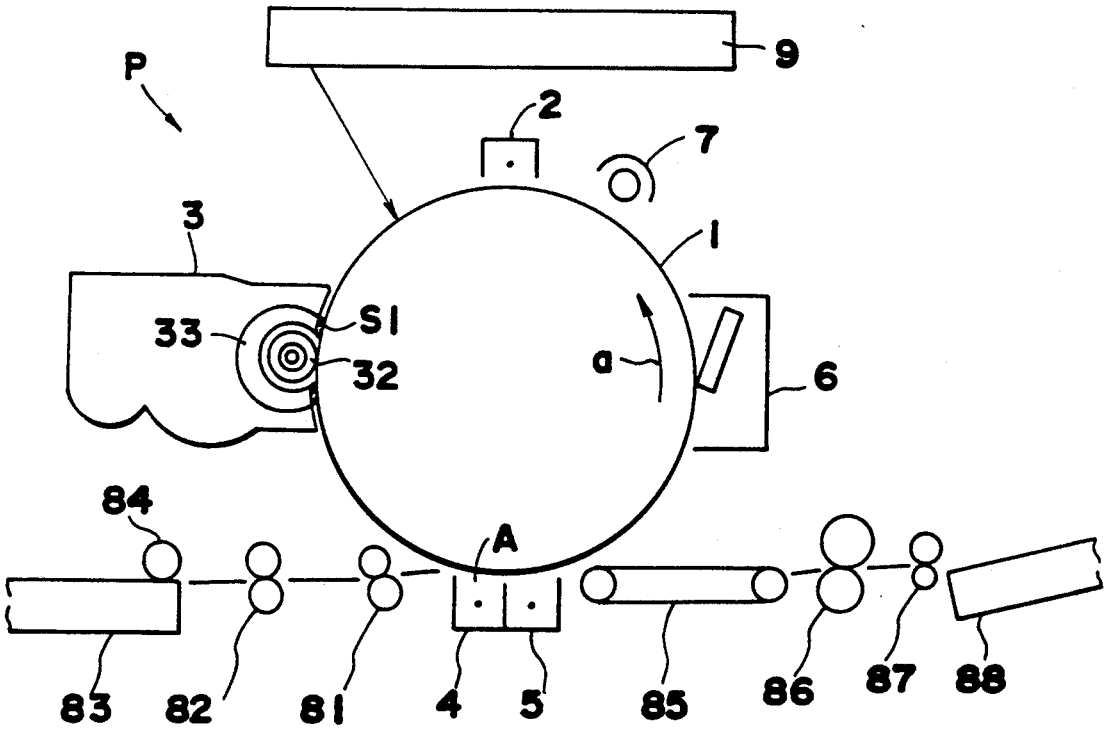
FIG. 1 is an illustration showing the essential construction of a printer using the first embodiment of the invention.

The preferred embodiments of the present invention are described hereinafter with reference to the accompanying drawings. FIG. 1 shows the essential construction of a first embodiment of a printer P.

The printer P provides a centrally disposed photosensitive drum 1 as the electrostatic latent image bearing member. Sequentially arranged around the circumference of the photosensitive drum 1 are a charger 2, developing device 3, transfer charger 4, separation charger 5, cleaner 6, and a eraser unit 7. Above the photosensitive drum 1 is provided an optical unit 9 for image exposure and including a semiconductor laser device and the like. On the upstream side of the transfer charger 4 are sequentially arranged timing rollers 81, intermediate rollers 82, and a paper cassette 83 which is confronted by a feed roller 84. On the downstream side of the transfer charger 4 are sequentially arranged a transfer sheet transporting belt 85, fixing rollers 86, discharge rollers 87, and a discharge tray 88.

According to the previously described image forming apparatus, the photosensitive drum 1 is rotatably driven in the direction of arrow [a] by a drive means not shown in the drawing. The surface of the photosensitive drum 1 is uniformly charged by the charger 2, and the charged region is then exposed to light in accordance with an image by means of the optical unit 9 so as to form an electrostatic latent image on the surface thereof. The thus formed electrostatic latent image is then developed into a toner image by the developing device 3, and the toner image arrives at the transfer region A of the transfer charger 4 in accordance with the rotation of the photosensitive drum 1.

On the other hand, a transfer sheet is extracted from the paper cassette 83 by the feed roller 84, passes through the intermediate rollers 82 and arrives at the timing rollers 81, then transported to the transfer region A in synchronization with the arrival of the toner image formed on the surface of the photosensitive drum 1. At the transfer region A, the toner image formed on the surface of the photosensitive drum 1 is transferred to the transfer sheet by the operation of the transfer charger 4, then the transfer sheet is separated from the photosensitive drum 1 by the separation charger 5, and transported via the transporting belt 85 to the fixing rollers 86 where the toner image is fixed to the transfer sheet. After the fixing process is completed, the transfer sheet is discharged by the discharge rollers 87 to the discharge tray 88.

Figure 2:
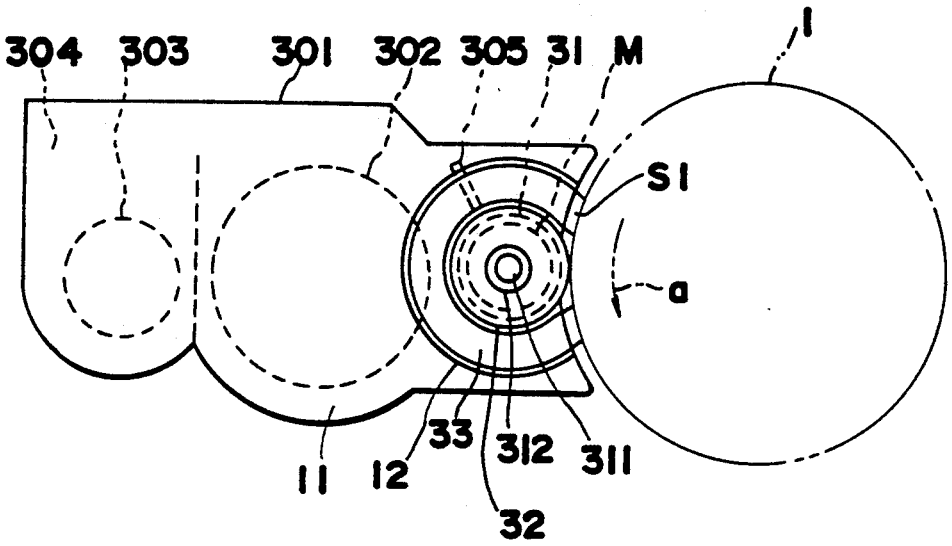
FIG. 2 is a side elevation view showing the positioning of the developing device relative to the photosensitive drum in the printer of FIG. 1.
Figure 3:
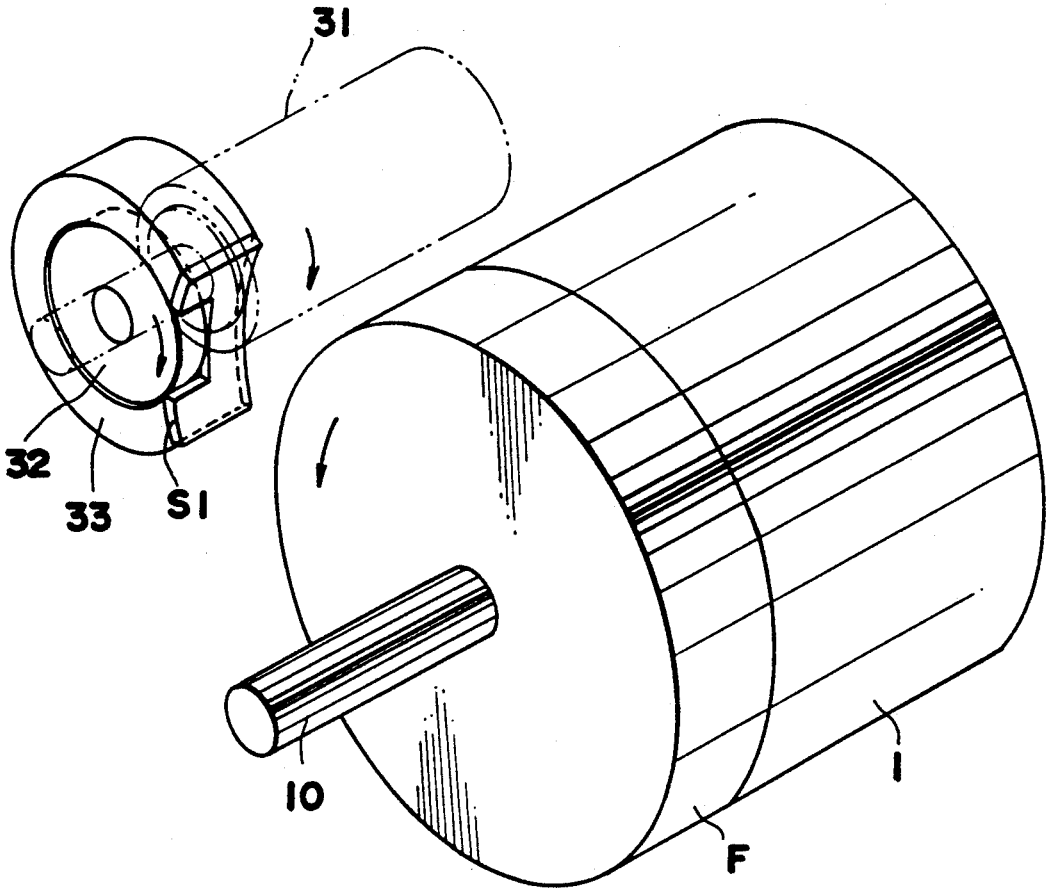
FIG. 3 is a perspective view showing the spacer collar, the housing circumscribing the spacer collar, the seal member and the flange at one end of the photosensitive drum at one side of the developing device of FIG. 2.
Figure 4:
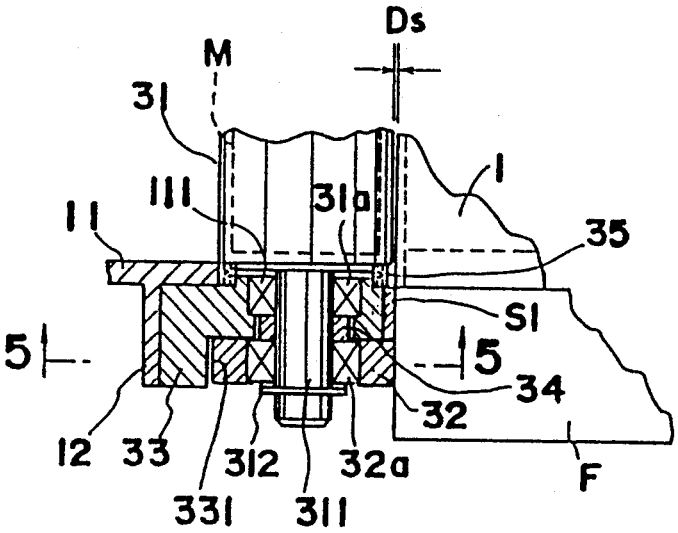
FIG. 4 is a section view of the spacer collar and a line along the rotational axis thereof.
Figure 5:
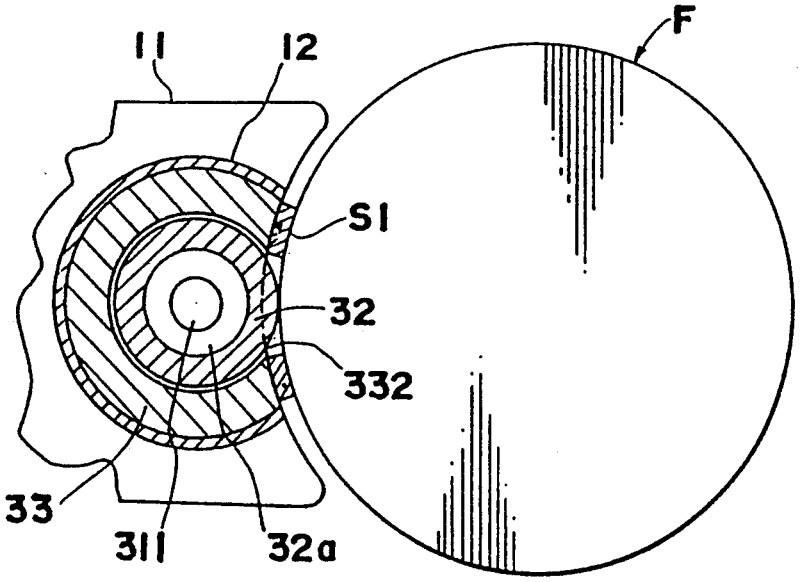
FIG. 5 is a section view along the 5—5 axis shown in FIG. 4.

Details of the positional relationships among the previously mentioned developing device and said device and the photosensitive drum are shown in FIGS. 2 through 5. FIG. 2 shows a side view of the developing device 3 positioned relative to the photosensitive drum 1. FIG. 3 is a perspective view of spacer collar 32, the housing 33 encasing spacer collar 32, the seal member S1, and the flange F at the end of the photosensitive drum 1 at one side of the developing device. FIG. 4 is a section view of the spacer collar 32 and a line along the rotational axis thereof. FIG. 5 is a section view along the 5—5 axis shown in FIG. 4.

As can be understood from FIG. 2, the developing device 3 has a casing 301, and within the casing 301 are provided a developing roller 31 as the developing material carrying member, a mixing-supplying member 302 for mixing and supplying developing material to the roller 31, a toner chamber 304 having a toner supplying screw 303, and a brush-height regulating member 305 confronting the developing roller 31. The developing device 3 accommodates a two-component developing material comprising a toner and a carrier.

An opening is formed in the front of the casing 301 from which protrudes a part of the developing roller 31 confronting the photosensitive drum 1. The developing roller 31 formed so as to be hollow, and a magnetic roller M is fixedly mounted within said roller 31.

An outwardly facing housing receptacle 12 (FIGS. 4 and 5) is formed in each side wall of the casing 301, such that the housing 33 is installed in each of said receptacles 12. The rotating shaft 311 of the developing roller 31 extends through the housing receptacles 12 via holes 111 formed in the side walls of the casing, and is rotatably supported on housing 33 through bearings 31*a* s as to rotatably driven by a drive means not shown in the drawings.

Housing 33 has a space 331 for accommodating the spacer collar 32; the spacer collar 32 disposed within the aforesaid space 331 is rotatably supported by the developing roller shaft 311 through the bearings 32*a*. Spacer rings 34 are interposed between the bearings 31*a* and 32*a* of the roller shaft 311, and a stopper 312 is fitted to the outside of the bearing 32*a* to prevent the bearing 32*a* from loosening from the shaft 311. The spacer collar 32 is encased in a housing 33 which has a cylindrical surface connecting to the side surface of the developing roller 31. The major diameter of the spacer collar 32 is larger than the major diameter of the developing roller 31 to allow for a developing gap Ds which is further described later.

Seal members 35 for sealing against the developing material are provided between the housing 33 and the exterior surface of the developing roller 31.

An opening 332 (FIG. 5) is formed on that portion of the housing 33 that confronts the photosensitive drum 1. A portion of the spacer collar 32 protrudes from the aforesaid opening 332 and abuts the surface of flange F at the end of the photosensitive drum 1.

A seal member S1 is arranged at the portions of the collar 32 protruding from the housing 33 and which is in contact with the flange F so as to be continuous at the upstream and downstream sides in the direction of rotation of the photosensitive drum 1. The seal member S1 is made of felt; one side the seal member S1 is adhered to housing 33, while the opposite side sweeps the surface of the flange F when the collar 32 is in a state of contact with the surface of said flange F of the photosensitive drum 1. The material of the aforesaid seal member S1 need not necessarily be made only of felt, but may also be made of sponge-like pliable synthetic resin, or a member having a polyester film superimposed over the aforesaid pliable synthetic resin.

Flanges F are provided at the ends of the photosensitive drum 1, as previously described. A part of the flange F is press fitted into the drum while the external portion is exposed outside the drum, as shown in the drawings, so as to provide attachment for the drum shaft 10 that rotatably supports the photosensitive drum 1. The surface of the exposed flange F portion is protected by a coating of electrically insulative material such as polytetrafluoroethylene.

Although only the front collar 32, the housing 333 encasing the collar and the seal member S1 at the front of the developing device, and the flange F at the front of the photosensitive drum are shown in the drawings, an identical spacing collar, housing and seal member are provided at the back side of the developing device so as to achieve right and left side symmetry, and an identical flange F is provided at the end of the photosensitive drum 1 on the back side thereof. The flange F at the back side comes into contact with the spacer collar on that side.

According to the preceding description of the developing device 3, the spacer collars 32 on both sides of the casing 301 rotate while in contact with the surfaces of the flanges F on both ends of the photosensitive drum 1, and thereby form the desired developing gap Ds between the surface of the developing roller 31 and the surface of the photosensitive drum 1. Accordingly, the electrostatic latent image formed on the surface of the photosensitive drum 1 is developed by the developing material brush formed on the surface of the developing roller 31 based on the aforesaid desired developing gap Ds.

The housing 3 is seated in the receptacles 12, and encases the exterior surface spacer collars 32 and the portion of spacer collars 32 at the side of the developing roller 31. A seal member S1 is arranged at the portions of the collar 32 protruding from the housing 33 and which is in contact with the flange F so as to be continuous at the upstream and downstream sides in the direction of rotation of the photosensitive drum 1. That is, the seal member S1 sweeps the surface of the flange F so as to prevent the adhesion to the spacer collar 32 of the airborne toner mainly in the vicinity of the surface of the photosensitive drum 1 and the surface of the developing roller 31. Further, the toner adhering to the surface of the flange F is cleaned therefrom by the seal member S1 before said toner reaches the collar 32. That is, the intrusion of toner into the region of contact between the collar 32 and the flange F is prevented, thereby eliminating any reduction in precision of the developing gap Ds that would be induced by such an intrusion of the toner. Thus, the precision of the developing gap Ds can be maintained in the desired condition over a long period of time.

The surface of contact between the spacer collar 32 and the flange F of the photosensitive drum 1 is protected by a coating of electrically insulative material such as polytetrafluoroethylene, and the flange F can therefore be electrically charged by the charging means to a suitably high electric potential. Therefore, even in a reverse developing process the developing material does not readily adhere to the aforesaid surfaces, and reduced accuracy of the developing gap is avoided. Since the polytetrafluoroethylene synthetic resin layer has a low friction coefficient, it is effective at reducing the load produced relative to the rotation of the flange. Moreover, the flange F itself may be made of an insulative material. Also, the ends of the photosensitive drum 1 may be coated with an insulative material and the spacer collar may contact the aforesaid ends of the drum, thereby developing device. The present embodiment uses a photosensitive belt B instead of the photosensitive drum 1 shown in FIG. 1. Accordingly, in the embodiments described below the developing devices are the focus of the discussion.

Figure 6:
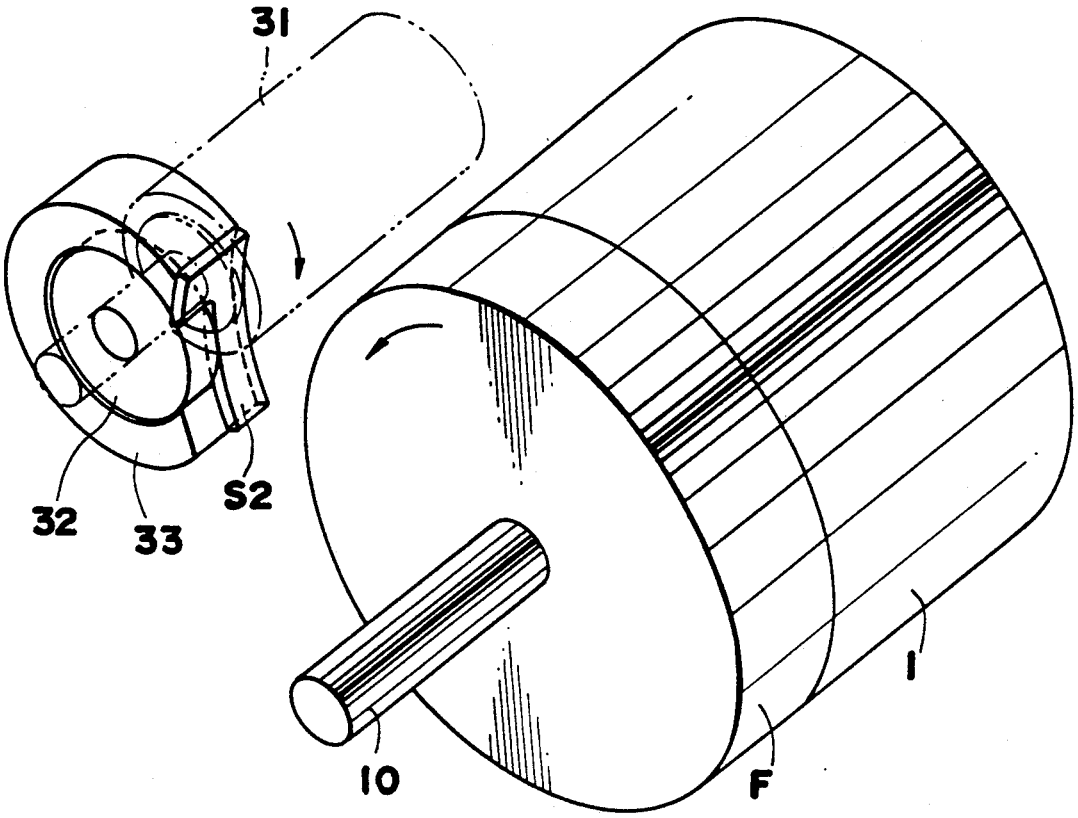
FIG. 6 is a perspective view showing the spacer collar, the housing encasing the collar, the seal member provided thereon at one side of the developing device, and the flange at one end of the photosensitive drum 1 in another example of a developing device.
Figure 7:
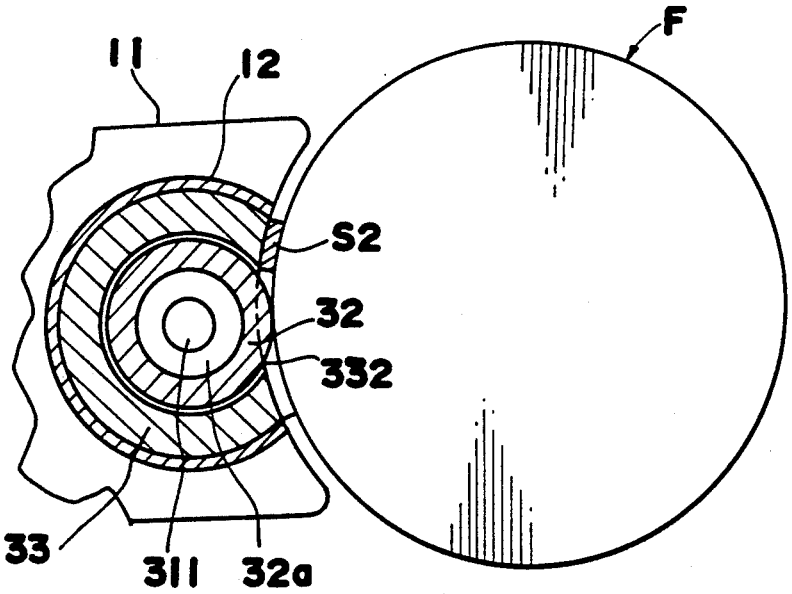
FIG. 7 is a section view similar to that of FIG. 5 showing the developing device of FIG. 6.

A further embodiment of the developing device is shown in FIGS. 6 and 7. FIG. 6 is a perspective view showing the spacer collar 32, the housing 33 encasing the collar, the seal member S2 provided thereon at one side of the developing device, and the flange F at one end of the photosensitive drum 1. FIG. 7 shows in the manner of FIG. 5 a section view of the developing device shown in FIG. 6.

This developing device uses a seal member S2 instead of the seal member S1 used in the developing device shown in FIGS. 2 through 5.

The seal member S2 is arranged at the portion of the collar 32 protruding from the housing 33 at the side of the developing roller 31 and which is in contact with the flange F so as to be continuous at the upstream side in the direction of rotation of the photosensitive drum 1. The seal member S2 is made of the same material as the seal member S1. The toner powder readily moves toward the spacer collar 32 from the toner transport region and the image region of the photosensitive drum 1, and readily intrudes between the collar 32 or the photosensitive drum 1 from the upstream side in the direction of rotation of the photosensitive drum 1 accordance with the rotation of said roller and said drum. Therefore, the seal member S2 is arranged at an upstream position in the aforesaid direction of rotation and at the side of the developing roller 31 of collar 32. Accordingly, just as with the previously described developing device, toner is prevented from intruding toward the contact region between the collar 32 and the flange F, and the developing gap Ds is maintained in the desired condition without reducing precision.

Figure 8:
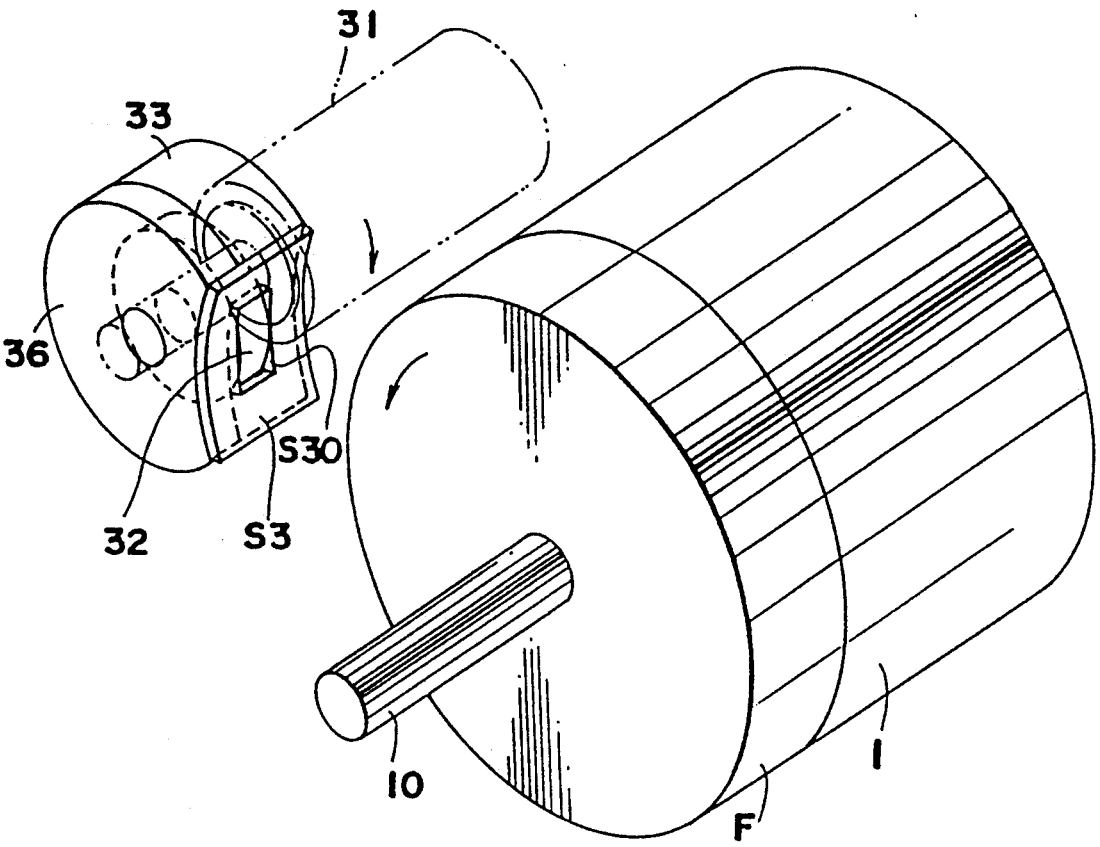
FIG. 8 is a perspective view showing the spacer collar, the housing encasing the collar, the seal member provided thereon at one side of the developing device, and the flange at one end of the photosensitive drum 1 in another example of a developing device.
Figure 9:
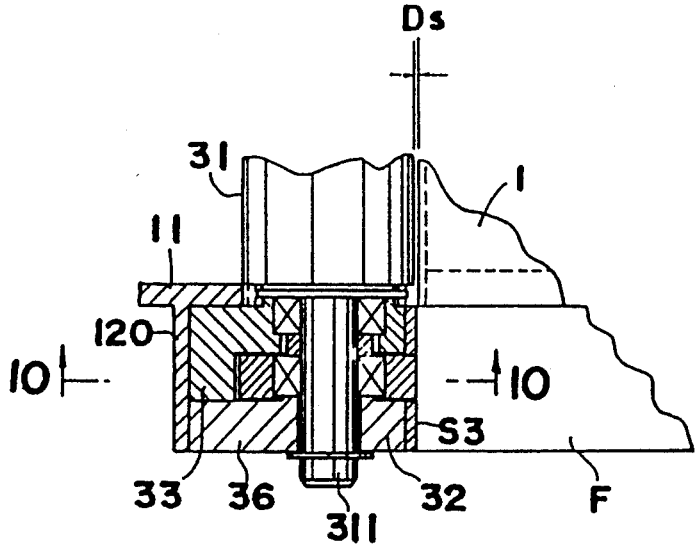
FIG. 9 is a section view of the spacer collar and a line along the rotational axis thereof.
Figure 10:
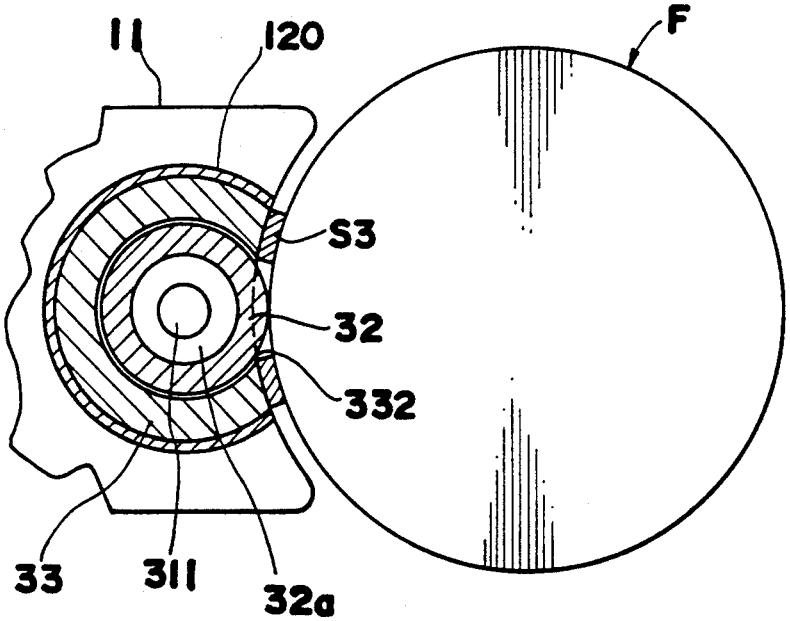
FIG. 10 is a section view along the 10—10 axis shown in FIG. 9.

A further embodiment of the developing device is shown in FIGS. 8 through 10. FIG. 8 is a perspective view showing the spacer collar 32, the housings 33 and 36 encasing the collar, and the seal member S3 provided at one side of the developing device, and the flange F at one end of the photosensitive drum 1. FIG. 9 shows a section view of spacer collar 32 along the rotational axis line. FIG. 10 shows a section view along the 10—10 axis in shown in FIG. 9.

This developing device shows the housing receptacle 12 shown in FIG. 5 extended slightly outwardly and designated receptacle 120, and shows an additional housing 36 on the outward side of housing 33. A seal member S3 is used instead of the seal member S1.

The side of the spacer collar 32 on the side of the developing roller 31 and the circumferential surface of the spacer collar 32 are surrounded by housing 33, and the side of the spacer 32 on the side opposite the developing roller 31 is surrounded by a casing 36. The seal member S3 provides a window S30 which contacts the flange of the photosensitive member opposite the collar 32, and surrounds the part of the collar 32 that protrudes from the opening of the housing on the side of the developing roller 31 and on the side opposite, and circumscribes the upstream and downstream sides thereof relative to the direction of rotation of the photosensitive drum 1.

In the previously described developing device the spacer collar 32 is isolated from the toner cloud intruding not only from the inner side of the spacer collar 32 but also from the outer side thereof, such that the developing material intrusion toward the contact region between the collar 32 and the flange F can be even more completely prevented, thereby assuring that the precision of the developing gap DS can be maintained over a long time period.

Figure 11:
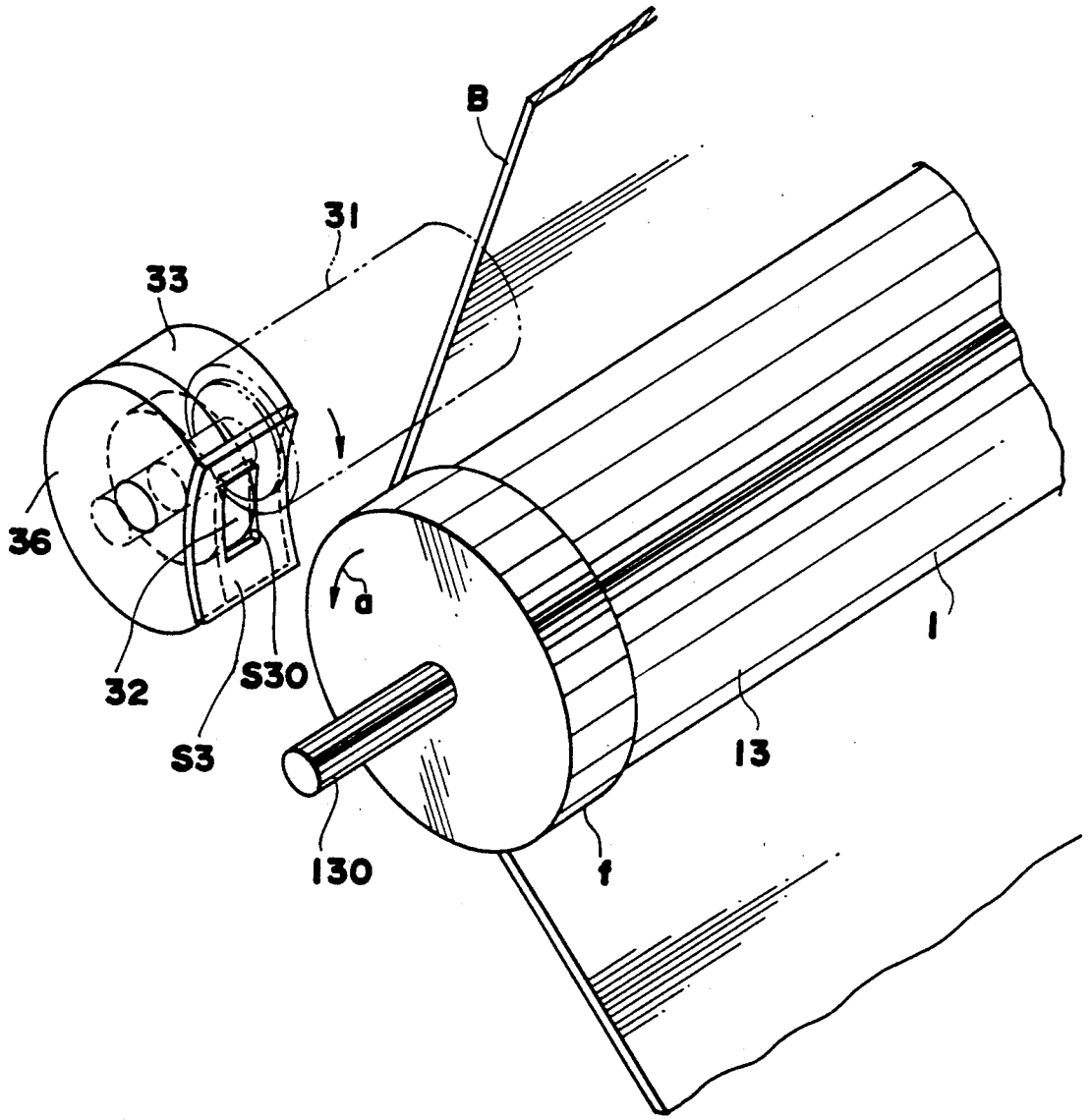
FIG. 11 is a perspective view showing an embodiment combining developing device and the electrostatic latent image bearing member.

FIG. 11 shows an embodiment wherein the developing device and the image bearing member are combined. This developing device is identical to that shown in FIG. 8; the electrostatic latent image bearing member is a photosensitive belt B. The belt B is guided by a belt guide roller 13 disposed parallel and opposite the developing roller 31 and a guide roller not shown in the drawings. Either of the aforesaid guide rollers may be rotatably driven in the direction of arrow [a] by a drive means not shown in the drawings.

To both ends of the guide roller 13 are provided flanges f on a shaft 130 of the roller 13. The major diameter of the flange f is equal to the major diameter of the previously described flange F, and the surface of said flange f is coated with an electrically insulative material.

In this construction, as in the previous embodiments, the developing gap Ds can be precisely maintained.

Although the foregoing embodiments have been described using a two-component developing material, the present invention may be adapted for developing devices using a monocomponent developing material.

Further, the spacer collar need not necessarily be rotatably provided on the developing roller 31, but may also, for example, be mounted to the casing 301 of the developing device.

Although the present invention has been fully described by way of examples with reference to the accompanying drawings, it is to be noted that various changes and modifications will be apparent to those skilled in the art. Therefore, unless otherwise such changes and modifications depart form the scope of the present invention, they should be construed as being included therein.

What is claimed is:

1. An image forming apparatus, comprising:

an image bearing member that is rotatable in a specified direction;

a developing material supplying means for supplying developing material to a latent image formed on the image bearing member;

a spacing roller rotatably and coaxially provided on the developing material supplying means and making contact with an edge of said image bearing member at a contact region therebetween extending in an axial direction of the image bearing member; and a seal member for preventing an intrusion of developing material into said contact region, said seal member circumscribing the contact region and having a portion that contacts the image bearing member at an upstream side of the contact region in a direction of rotation of the image bearing member and a portion that contacts the image bearing member at an inner side of said contact region.

2. The image forming apparatus according to claim 1, wherein said developing material supplying means includes a developing roller, said spacing roller being concentrically arranged to a rotating shaft of the developing roller, and wherein a diameter of the spacing roller is larger than a diameter of the developing roller.

3. The image forming apparatus according to claim 2, further comprising a housing for covering a side of said spacing roller on a side of the developing roller and a circumferential surface of the spacing roller, the housing having a surface which confronts the image bearing member, said seal member being attached to a surface of the housing confronting the image bearing member.

4. The image forming apparatus according to claim 3, further comprising a second seal member which is attached to said surface of said housing and makes contact with the image bearing member at a downstream side of said contact region in the direction of rotation of the image bearing member so as to seal up the contact region.

5. The image forming apparatus according to claim 4, further comprising a third seal member which makes contact with said image bearing member at an outer side of the contact region on a side opposite the developing roller so as to seal up the contact region.

6. The image forming apparatus according to claim 5, wherein said housing also covers a side of the spacing roller on the side opposite the developing roller.

7. An image forming apparatus which comprises developing means for developing an electrostatic latent image on an image bearing member in a reversing development process, said apparatus comprising:

a flange fitted into an end of the image gearing member under a press and a surface thereof being made of electrically insulative material; and a positioning roller for positioning the developing means relative to the image bearing member, said positioning roller being rotatably disposed to an end of the developing means so as to contact said flange.

8. The image forming apparatus according to claim 7, wherein said insulative material is composed of fluorine resin.

9. An image forming apparatus, comprising:

an image bearing member for bearing an electrostatic latent image, said image bearing member being rotatable in a direction and an edge thereof being made of an electrically insulative material;

a developing means for developing the electrostatic latent image in a reversing development process, said developing means including developing material and a developing roller;

a positioning roller rotatably supported on a rotating shaft of the developing roller and making contact with the edge of said image bearing member so as to position the developing roller relative to the image bearing member;

a housing for covering said positioning roller, said housing having an opening wherefrom said positioning roller protrudes on a surface of the housing that confronts said image bearing member; and a seal member provided around the opening so as to seal up a gap between said housing and said image bearing member.

10. A developing device, comprising:

a developing material supplying roller rotatably provided in a neighborhood of a moving image bearing member bearing an electrostatic latent image;

a spacer collar disposed on both ends of a rotating shaft of said developing material supplying roller and making contact with an edge of the image bearing member;

a housing for covering said spacer collar, said housing having an opening wherefrom said spacer collar protrudes; and a seal member provides around the opening, a thickness of said seal member being not shorter than a length thereof whereby said spacer collar protrudes from said opening.

* * * * *

UNITED STATES PATENT AND TRADEMARK OFFICE

CERTIFICATE OF CORRECTION

PATENT NO. 5,293,199

DATED March 8, 1994

INVENTOR(S) Naomasa Saito, et al.

It is certified that error appears in the above-indentified patent and that said Letters Patent is hereby corrected as shown below:

In Col. 5, lines 12 and 13, change, "s as to" to -- so as to be --.

In Col. 5, line 60, change "333" to -- 33 --.

In Col. 6, line 15, change "3" to -- 33 --.

In Col. 6, line 16, after "surface" insert -- of --.

In Col. 6, line 53, after "thereby" insert

-- preventing damage to the photosensitive layer.

Another embodiment of the present invention is described hereinafter. The construction of this embodiment is substantially similar to that of the previously described embodiment except for some differences in the --.

In Col. 7, line 12, after "drum 1" insert -- in --.

In Col. 9, line 11 (claim 7, line 5), change "gearing" to -- bearing --.

In Col. 10, line 26 (claim 10, line 12), change "provides" to -- provided --.

UNITED STATES PATENT AND TRADEMARK OFFICE

CERTIFICATE OF CORRECTION

PATENT NO. : 5,293,199

DATED : March 8, 1994

INVENTOR(S) : Naomasa Saito, et al

It is certified that error appears in the above-indentified patent and that said Letters Patent is hereby corrected as shown below:

In column 7, line 12, after "drum 1" insert -- in --.

In column 9, line 11 (claim 7, line 5), change "gearing" to --bearing --.

In column 10, line 26, (claim 10, line 12,) change "provides" to -- provided --.

Signed and Sealed this

Sixteenth Day of August, 1994

*Attest:*

*Attesting Officer*

BRUCE LEHMAN

*Commissioner of Patents and Trademarks*